US008142639B2

(12) United States Patent
Orihashi et al.

(10) Patent No.: US 8,142,639 B2
(45) Date of Patent: Mar. 27, 2012

(54) HARD GOLD ALLOY PLATING BATH

(75) Inventors: Masanori Orihashi, Ageo (JP); Yasushi Takizawa, Ageo (JP)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 776 days.

(21) Appl. No.: 11/894,444

(22) Filed: Aug. 21, 2007

(65) Prior Publication Data

US 2009/0000953 A1 Jan. 1, 2009

(30) Foreign Application Priority Data

Aug. 21, 2006 (JP) ..... 2006-224465

(51) Int. Cl.
*C25D 3/62* (2006.01)
*C25D 3/48* (2006.01)

(52) U.S. Cl. ..... 205/250; 205/247; 205/268

(58) Field of Classification Search ..... 205/247, 205/255, 259, 250, 268
See application file for complete search history.

(56) References Cited

U.S. PATENT DOCUMENTS 4,367,123 A * 1/1983 Beck ..... 205/129
4,391,679 A * 7/1983 Zilske et al. ..... 205/247
4,396,471 A * 8/1983 Fletcher et al. ..... 205/250

FOREIGN PATENT DOCUMENTS

DE 2213039 A1 * 9/1973
GB 1177373 A * 1/1970
RU 1788096 A1 * 1/1993

* cited by examiner

*Primary Examiner* — Edna Wong
(74) *Attorney, Agent, or Firm* — John J. Piskorski

(57) ABSTRACT

A hard gold plating solution and plating method which provides a gold plating solution with high deposition selectivity using a gold plating solution containing gold cyanide, cobalt salt, and hexamethylenetetramine.

4 Claims, No Drawings

HARD GOLD ALLOY PLATING BATH

The present invention relates to an acidic gold cobalt alloy plating solution.

In recent years, gold plating has been widely used in electronic devices and electronic components to protect the surface of contact terminals of electronic components, or the like, because of gold's excellent electrical characteristics and corrosion resistance, and the like. Gold plating is used as a surface treatment for the electrode terminals of semiconductor elements, or as a surface treatment for electronic components such as the connectors which connect to electronic devices, or as the leads formed on a plastic film. Materials which use gold plating include metal, plastic, ceramic, and semiconductors, or the like.

The connectors used to connect electronic devices use hard gold plating because the manner of use demands that the gold plating film used for surface treatment have corrosion resistance, wear resistance, and electrical conductivity. Examples of hard gold plating have been long known, including gold cobalt alloy plating and gold nickel alloy plating, and the like as disclosed in DE 1111897 and JP S60-155696.

Electronic components such as connectors are generally made from copper or copper alloy. When gold plating is performed as a surface treatment, the surface of the copper is normally nickel plated to form a barrier layer for the copper material. Gold plating is then performed on the surface of the nickel plating layer.

Standard methods used to perform localized hard gold plating on these electronic components such as connectors include spot plating, plating with restricted liquid surface, rack plating, and barrel plating, or the like.

However, there is a problem with conventional gold plating solutions that when performing localized plating of the regions of the electronic component which require a gold plating film, the gold or gold alloy will also be deposited on the surrounding areas or in other words the areas which do not require a gold plating film.

An object of the present invention is to provide a hard gold plating solution and plating method which maintains the properties of the gold film on the connector surface and which deposits a gold plating film on desired regions but restricts plating on undesired regions.

In order to resolve the aforementioned problems and as a result of diligent investigations into hard gold plating solutions, the present inventors have discovered that a hard gold plating film which has the corrosion resistance, wear resistance, and electrical conductivity demanded for connector applications can be formed, and deposition of the gold plating film to unneeded areas can be suppressed by keeping the gold cobalt plating solution weakly acidic and adding hexamethylenetetramine, and have thus achieved the present invention.

One aspect of the present invention is a hard gold plating method used as a surface treatment for connectors, and provides a gold cobalt plating method which performs electrolytic plating using an acidic plating aqueous solution consisting of gold cyanide salt, soluble cobalt salt, conductive salt component, chelating agent, hexamethylenetetramine, and if necessary a pH adjuster.

The acidic plating solution of the present invention is able to use a broad range of current density, and in particular is able to provide a favorable hard gold plating film even with a high current density. By forming a hard gold plating film which has the corrosion resistance, wear resistance, and electrical conductivity required for electronic components such as connectors using the hard gold plating solution of the present invention, the gold plating film can be deposited in the desired locations while deposition in undesired locations can be suppressed. In other words, the hard gold plating of the present invention has excellent deposition selectivity. Preventing the deposition of the plating film in areas where the plating film is unneeded can reduce the unnecessary consumption of gold, and is therefore advantageous from an economic viewpoint.

The hard gold plating solution of the present invention comprises gold cyanide salt, soluble cobalt salt, conductive salt component, chelating agent, and hexamethylenetetramine, and if necessary may also comprise a pH adjuster. The hard gold plating solution of the present invention is kept acidic, and in particular, the pH is between 3 and 6.

The source of gold ion which is a critical component of the present invention may be potassium dicyanoaurate, potassium tetracyanoaurate, ammonium cyanoaurate, potassium dichloroaurate, sodium dichloroaurate, potassium tetrachloroaurate, sodium tetrachloroaurate, gold potassium thiosulfate, gold sodium thiosulfate, gold potassium sulfite, gold sodium sulfide, and combinations of two or more thereof. Preferred plating solutions of the present invention use gold cyanide salt, and in particular potassium dicyanoaurate.

The quantity of these gold salts added to the plating solution is generally such that the gold concentration is within a range of 1 g/L to 20 g/L, and preferably within a range between 3 g/L and 16 g/L.

The source of the cobalt that can be used with the present invention may be any soluble cobalt compound, such as cobalt sulfate, cobalt chloride, cobalt carbonate, cobalt sulfamate, cobalt gluconate, and combinations of two or more thereof. For the plating solution of the present invention, inorganic cobalt salts and particularly basic cobalt carbonate is preferable.

The quantity of cobalt salts in the plating solution is generally such that the cobalt concentration is within a range of 0.05 g/liter to 3 g/liter, and preferably within a range between 0.1 g/L to 1 g/L.

The chelating agents which can be used with the present invention may be any commonly known compound. Examples include citric acid, calcium citrate, sodium citrate, tartaric acid, oxalic acid, succinic acid, or other compounds containing carboxyl groups or compounds having a phosphonic acid group or salt thereof in the molecule. Examples of compounds containing phosphonic acid include aminotrimethylene phosphonic acid, 1-hydroxyethylidene-1,1-diphosphonic acid, ethylenediamine tetramethylene phosphonic acid, diethylenetriamine pentamethylene phosphonic acid and other compounds having a plurality of phosphonic acid groups within the molecule as well as alkali metal salts or ammonium salts thereof. Furthermore, nitrogen compounds such as ammonia, ethylenediamine, or triethanolamine may also be used as an auxiliary chelating agent together with a compound containing carboxyl groups. The chelating agent may also be a combination of two or more types. The aforementioned chelating agents may also be compounds which act as the post-mentioned conductive salt. The use of compounds which act as a chelating agent and also act as a conductive salt is preferable.

The amount of chelating agent added to the plating solution is generally within a range of 0.1 g/L to 300 g/L, and preferably between 1 g/L and 200 g/L.

The conductive salts which may be used with the present invention may be either organic compounds or inorganic compounds. Examples of these organic compounds are the aforementioned compounds which act as chelating agents, and include citric acid, tartaric acid, adipic acid, malic acid, succinic acid, lactic acid, and benzoic acid, as well as other compounds containing carboxylic acid or salts thereof or phosphoric acid groups or salts thereof. Examples of these inorganic compounds include the alkali metal salts or ammonium salts of phosphoric acid, sulfurous acid, nitrous acid, nitric acid, or sulfuric acid. Furthermore, combinations of two or more of these compounds may be used. Preferably the salt forms such as ammonium dihydrogen phosphate or diammonium phosphate are added.

The amount of conductive salt added to the plating solution is generally between 0.1 g/L and 300 g/L, and preferably between 1 g/L and 200 g/L.

The hexamethylenetetramine which is a critical component of the present invention is added to the plating solution to be generally within a range of between 0.05 g/L and 10 g/L, and preferably between 0.1 g/L and 5 g/L.

The pH of the hard gold plating solution of the present invention is adjusted to the acidic region. Preferably the pH is between 3 and 6. More preferably the pH is adjusted to be between 3.5 and 5. The pH can be adjusted by adding alkali metal hydroxides such as potassium hydroxide, or the like, or acidic substances such as citric acid, or phosphoric acid. The addition of compounds which provide a pH buffering effect to the gold plating solution is particularly preferable. Examples of compounds which have a pH buffering effect include citric acid, tartaric acid, oxalic acid, succinic acid, phosphoric acid, sulfurous acid, as well as salts thereof. By adding these compounds which have a pH buffering effect, the pH of the plating solution can be kept uniform and the plating operation can be performed for a long period of time.

The hard gold plating solution of the present invention may be adjusted or may use any commonly known method for the aforementioned components. For instance, the plating solution of the present invention can be obtained by simultaneously or individually adding the afore-mentioned amounts of gold cyanide or salt thereof, soluble cobalt salt, conductive salt component, chelating agent, and hexamethylenetetramine to water and stirring, and then adjusting the pH by adding a pH adjuster or a pH buffer if necessary.

When performing the hard gold plating of the present invention, the temperature of the plating solution should be between 20° and 80° C., preferably between 30° and 60° C. The current density can be within a range of 0.1 to 60 A/dm$^2$. In particular, the plating solution of the present invention can use a high current density of between 20 and 60 A/dm$^2$. The cathode may be either a soluble cathode or an insoluble cathode, but the use of an insoluble cathode is preferable. Preferably the plating solution is agitated during electrolytic plating.

The method for producing a connector using the hard gold plating solution of the present invention may be a commonly known method. A standard method such as spot plating, plating with restricted liquid surface, rack plating, or barrow plating, or the like, may be used to perform localized hard gold plating of electronic components such as connectors.

When gold plating is to be the final surface of the connector, an intermediate metallic layer such as a nickel film, or the like, is preferably formed by nickel plating on the surface of the connector component. A gold film can then be formed using the gold alloy plating solution of the present invention by spot electrolytic plating on a conductive layer such as the nickel film.

Embodiment 1

A gold cobalt plating solution consisting of the following substances was prepared.

| | |
|---|---|
| potassium dicyanoaurate | 6 g/L (4 g/L of gold) |
| basic cobalt carbonate | 1.74 g/L (0.25 g/L of cobalt) |
| tripotassium citrate monohydrate | 30 g/L |
| ammonium dihydrogen phosphate | 5 g/L |
| hexamethylenetetramine | 1.5 g/L |
| anhydrous citric acid | 22.87 g/L |
| water (deionized water) | remainder |

The pH of the aforementioned plating solution was adjusted to a pH of 4.3 using potassium hydroxide.

A copper plate onto which nickel plating was deposited as an undercoat was prepared as the object for plating. In order to confirm the selective deposition properties of the gold plating film, a mask was formed using silicon rubber across the whole surface of the copper plate, and then a section of the mask (10 mm diameter) was removed. However, a gap between the nickel plating layer and the mask layer of the mask section (width 1.5 mm) along the edge of the section without mask was formed by pressing a 0.5 mm thick epoxy resin plate between the mask layer and the nickel plated layer around the edge of the exposed section without mask. Therefore, when the object for plating was immersed in the plating solution, the plating solution was able to penetrate into the gap section between the mask layer and the nickel plating layer. The mask layer was present above this gap section so compared to the exposed section without mask, the current density was low during electrolysis.

The aforementioned object for plating was immersed in the prepared plating solution, and gold plating was performed at a bath temperature of 50° C. while agitating by pump, using a titanium platinum insoluble cathode at the current densities shown in Table 1. The plating time was one second for each. At this time, a hard gold plating film with a film thickness of 0.1 μm was formed on the object for plating. The range of deposition away from the exposed region without mask of the object for plating was measured as the deposition selectivity of the plating film. The length of deposition in the region outside of the region without mask is shown in Table 1. The units are in micrometers (μm).

COMPARATIVE EXAMPLE 1

As an example of a conventional hard plating solution, gold cobalt plating solution was prepared which was identical to embodiment 1 except that hexamethylenetetramine was not included, and this solution was tested in the same manner as embodiment 1. The results are shown in Table 1.

TABLE 1

| | 20 ASD | 30 ASD | 40 ASD | 50 ASD | 60 ASD |
|---|---|---|---|---|---|
| Embodiment 1 | 0.003 | 0.003 | 0.003 | 0.002 | 0.002 |
| Comparative Example 1 | 0.027 | 0.021 | 0.035 | 0.042 | 0.027 |

Embodiment 2

Gold cobalt plating solutions were prepared which were identical to embodiment 1 except that the amount of hexamethylenetetramine was changed to the quantities shown in Table 2.

COMPARATIVE EXAMPLES 2-8

Gold cobalt plating solutions were prepared which were identical to embodiment 1 except that the compounds shown in Table 2 were added in the quantities shown in place of the hexamethylenetetramine. A hull cell test was performed as shown below on the plating baths of embodiment 2, comparative example 1, and comparative examples 2 through 8.

Hull Cell Test

Using a platinum clad titanium insoluble cathode and a copper hull cell panel anode, a hull cell test was performed with a current between the cathode and anode of 1 A for 3 minutes in a 50° C. bath while agitating with a cathode rocker at a speed of 2 m/minute.

The appearance of the hull cell panels are shown as the results in Table 2. The results of fluorescent x-ray thin film thickness gauge (SFT-9400, manufactured by SII) measurements of the plating film are shown in Table 3 for a total of nine locations (1-9 in order from the left) locations 1 cm below the hull cell panel beginning at a point 1 cm from the left edge (high current density side) and continuing to a point 1 cm from the right edge (low current density side) at 1 cm intervals.

TABLE 2

| | | | Appearance | |
|---|---|---|---|---|
| | | Concentration | Plating Burn Region | Glossy region |
| Embodiment 2 | hexamethylenetetramine | 1 g/L | 3 cm | 7 cm |
| | | 2 g/L | 2 cm | 8 cm |
| | | 3 g/L | 2 cm | 8 cm |
| | | 5 g/L | 2 cm | 8 cm |
| Comparative Example 1 | Standard bath | — | 5.5 cm | 4.5 cm |
| Comparative Example 2 | Saccharine | 1 g/L | 4 cm | 6 cm |
| | | 5 g/L | 4 cm | 6 cm |
| Comparative Example 3 | Bipyridyl | 1 g/L | 2 cm | 8 cm |
| | | 5 g/L | 3 cm | 7 cm |
| Comparative Example 4 | Barbituric acid | 1 g/L | 4.5 cm | 5.5 cm |
| | | 5 g/L | 4.5 cm | 5.5 cm |
| Comparative Example 5 | Tetraethylene pentamine | 1 g/L | 6 cm | 4 cm |
| | | 5 g/L | 6 cm | 4 cm |
| Comparative Example 6 | Triethylene tetramine | 1 g/L | 7 cm | 3 cm |
| | | 5 g/L | 7 cm | 3 cm |
| Comparative Example 7 | Pyridyl 3 sulfonic acid | 1 g/L | 3.5 cm | 6.5 cm |
| | | 5 g/L | 3 cm | 7 cm |
| Comparative Example 8 | Imidazole | 1 g/L | 4 cm | 6 cm |
| | | 5 g/L | 4 cm | 6 cm |

TABLE 3

| | Concentration | Measurement Points and Film Thickness (μm) | | | | | | | | |
|---|---|---|---|---|---|---|---|---|---|---|
| | | 1 | 2 | 3 | 4 | 5 | 6 | 7 | 8 | 9 |
| Embodiment 1 | 1 g/L | 0.662 | 0.818 | 0.774 | 0.633 | 0.628 | 0.568 | 0.432 | 0.241 | 0.188 |
| | 2 g/L | 0.598 | 0.621 | 0.667 | 0.624 | 0.566 | 0.509 | 0.402 | 0.208 | 0.102 |
| | 3 g/L | 0.592 | 0.603 | 0.652 | 0.511 | 0.492 | 0.397 | 0.269 | 0.174 | 0.054 |
| | 5 g/L | 0.55 | 0.54 | 0.456 | 0.315 | 0.247 | 0.183 | 0.145 | 0.051 | 0.022 |
| Compararive Ex 1 | — | 0.788 | 0.889 | 0.825 | 0.854 | 0.796 | 0.829 | 0.6 | 0.32 | 0.309 |
| Comparative Example 2 | 1 g/L | 0.693 | 0.715 | 0.671 | 0.568 | 0.494 | 0.625 | 0.48 | 0.322 | 0.177 |
| | 5 g/L | 0.659 | 0.668 | 0.637 | 0.67 | 0.708 | 0.751 | 0.627 | 0.337 | 0.229 |
| Comparative Example 3 | 1 g/L | 0.637 | 0.568 | 0.584 | 0.637 | 0.631 | 0.661 | 0.45 | 0.297 | 0.25 |
| | 5 g/L | 0.551 | 0.578 | 0.568 | 0.601 | 0.567 | 0.598 | 0.467 | 0.312 | 0.212 |
| Comparative Example 4 | 1 g/L | 0.456 | 0.593 | 0.604 | 0.57 | 0.683 | 0.685 | 0.538 | 0.302 | 0.167 |
| | 5 g/L | 0.51 | 0.608 | 0.598 | 0.572 | 0.686 | 0.617 | 0.601 | 0.379 | 0.221 |
| Comparative Example 5 | 1 g/L | 0.591 | 0.61 | 0.655 | 0.606 | 0.537 | 0.542 | 0.386 | 0.28 | 0.172 |
| | 5 g/L | 0.515 | 0.49 | 0.494 | 0.524 | 0.479 | 0.443 | 0.291 | 0.205 | 0.11 |
| Comparative Example 6 | 1 g/L | 0.459 | 0.598 | 0.616 | 0.598 | 0.55 | 0.511 | 0.378 | 0.302 | 0.155 |
| | 5 g/L | 0.546 | 0.648 | 0.56 | 0.593 | 0.545 | 0.545 | 0.429 | 0.279 | 0.229 |
| Comparative Example 7 | 1 g/L | 0.661 | 0.734 | 0.717 | 0.731 | 0.707 | 0.645 | 0.495 | 0.303 | 0.194 |
| | 5 g/L | 0.541 | 0.56 | 0.623 | 0.645 | 0.566 | 0.74 | 0.508 | 0.362 | 0.215 |
| Comparative Example 8 | 1 g/L | 0.589 | 0.658 | 0.665 | 0.677 | 0.668 | 0.631 | 0.481 | 0.286 | 0.218 |
| | 5 g/L | 0.585 | 0.645 | 0.635 | 0.628 | 0.573 | 0.636 | 0.52 | 0.262 | 0.243 |

From the results of the hull cell test, as shown in Table 2, the plating solution of the present invention was confirmed to have a broad glossy range, and to form a favorable plating film even at high current densities. Furthermore, as shown in Table 3, it was confirmed that plating deposition is poor in low-current-density regions. The fact that the plating deposition properties are poor in low-current-density regions shows that plating deposition will not occur in regions where deposition is not desired, and means that the plating deposition selectivity will be excellent.

As shown by the aforementioned embodiments, when electrolytic plating using the hard gold plating solution of the present invention, a gold alloy plating film will be deposited in the desired regions across a broad range of current density, and deposition of the gold alloy plating film will be suppressed in undesired regions, and therefore a hard gold plating film with improved deposition selectivity can be provided.

What is claimed is:

1. A method for forming a hard gold plating film by electrolytic plating with high current density comprising:

a) providing a gold alloy electrolytic plating solution comprising gold cyanide, a soluble cobalt salt, an inorganic conductive salt component, hexamethylenetetramine and an acid or salt thereof selected from the group consisting of citric acid, tartaric acid, oxalic acid, succinic acid, adipic acid, malic acid, lactic acid, benzoic acid, compounds containing phosphoric acid groups, sulfurous acid, aminotrimethylene phosphonic acid, 1-hydroxyethylidene pentamethylene-1,1-diphosphonic acid, ethylenediamine tetramethylene phosphonic acid and diethylenetriamine pentamethylene phosphonic acid;

b) immersing an electronic component in the gold alloy electrolytic plating solution; and c) generating a current density of between 20 and 60 A/dm$^2$ to electrolytically plate a hard gold plating film on the electronic component.

2. The method according to claim 1, wherein the pH of the gold alloy electrolytic plating solution is between 3 and 6.

3. The method of claim 1, wherein the hard gold film is deposited on a nickel layer on the electronic component.

4. The method of claim 3, wherein the hard gold film is deposited on the nickel layer of the electronic component by spot electrolytic plating.

* * * * *